US006608543B2

(12) United States Patent
Rapoport et al.

(10) Patent No.: US 6,608,543 B2
(45) Date of Patent: Aug. 19, 2003

(54) HIGH PULSE RATE IGNITION SYSTEM

(75) Inventors: William R. Rapoport, Bridgewater, NJ (US); Paul A. Papanestor, Milford, PA (US); Donald Allen Grimes, Findlay, OH (US); Bruce VanBuskirk, Dover, NJ (US); Gordon E. Fish, Upper Montclair, NJ (US)

(73) Assignee: Honeywell International, Inc., Morris Township, NJ (US)

( * ) Notice: Subject to any disclaimer, the term of this patent is extended or adjusted under 35 U.S.C. 154(b) by 0 days.

(21) Appl. No.: 10/281,865

(22) Filed: Oct. 28, 2002

(65) Prior Publication Data

US 2003/0048165 A1 Mar. 13, 2003

Related U.S. Application Data

(60) Division of application No. 09/658,083, filed on Sep. 11, 2000, now Pat. No. 6,535,096, which is a continuation-in-part of application No. 08/933,483, filed on Sep. 18, 1997, now abandoned.

(51) Int. Cl.[7] ..... H01F 27/02

(52) U.S. Cl. ..... 336/90; 336/96; 29/602.1; 123/634

(58) Field of Search ..... 123/634, 635, 123/599, 406; 336/90, 92, 96, 107, 198; 29/602.1, 606, 605

(56) References Cited

U.S. PATENT DOCUMENTS 4,368,447 A * 1/1983 Inomata et al. ..... 336/20
6,270,591 B2 * 8/2001 Chiriac et al. ..... 148/300

* cited by examiner

*Primary Examiner*—Anh Mai

(57) ABSTRACT

An ignition system for igniting fuel in a gas turbine or diesel engine is described. The system includes a magnetic core-coil assembly having a magnetic core comprising at least one tape wound toroid of ferromagnetic amorphous metal alloy, a primary winding and a secondary winding. Also included are driver electronics for applying voltage to a spark plug to cause a spark to ignite the fuel. The core-coil assembly and driver electronics are capable of operating with a rapid charge and discharge cycle to produce a high spark pulse rate. In another aspect, a magnetic core-coil assembly is disclosed which has a magnetic core comprising at least one tape wound toroid of ferromagnetic amorphous metal alloy having a permeability ranging from about 250 to 500, a primary winding for low voltage excitation and a secondary winding for high voltage output.

28 Claims, 12 Drawing Sheets

Figure 5: Open circuit output voltage as a function of peak Ampere-turns at primary opening.

Top trace: d-COP Output Voltage 5 kV/div.
Lower Trace: Input current into primary 20A/div.
Time base 20 microseconds/div.
12 volt input source on primary switching system d-COP Output Voltage 5 kV/div.
Time base 1 microsecond/div.

HIGH PULSE RATE IGNITION SYSTEM

CROSS-REFERENCE TO RELATED APPLICATION

This application is a division of application Ser. No. 09/658,083, filed Sep. 11, 2000, now U.S. Pat. No. 6,535,096, which is a continuation-in-part of U.S. application Ser. No. 08/933,483, filed Sep. 18, 1997 now abandoned.

BACKGROUND OF THE INVENTION

1. Field of the Invention

This invention relates to spark ignition systems for gas turbine and diesel engines that operate on diesel, natural gas or alternative fuels and require at least an initial ignition source.

2. Description of the Prior Art

Current gas turbine engines for power production such as those used for hybrid electric vehicles and power generation require very high energy spark ignition systems due to use of low volatility fuels that are difficult to ignite. Typical high energy ignition systems are those used in the avionic industry for auxiliary power units (APUs). Some of these systems have severe emission control requirements that can be met only by providing very high energy ignition sources in order to start the engine before too much unburned fuel is released through the exhaust system. Diesel engines require glo-plugs to initiate combustion. In this case the glo-plug tip is heated to temperatures of >2000° F. which typically takes large amounts of current (~8 amps per plug) and lengthy warm up times.

To achieve the spark ignition performance needed for ignition and, at the same time, reduce the incidence of spark plug soot fouling, the spark ignition transformer core material must possess certain properties. Such core material must have moderately high magnetic permeability, must not magnetically saturate during operation, and must have low magnetic losses. The combination of these required properties severely curtails the availability of suitable core materials. Possible candidates for the core material include silicon steel, ferrite, and iron-based amorphous metal. Conventional silicon steel routinely used in utility transformer cores is inexpensive, but its magnetic losses are too high. Thinner gauge silicon steel with lower magnetic losses is too costly. Ferrites are inexpensive, but their saturation inductions are normally less than 0.5 T and Curie temperatures at which the core's magnetic induction becomes close to zero are near 200° C. This temperature is too low because a spark ignition transformer's upper operating temperature is typically about 180° C. Conventional iron-based amorphous metal has low magnetic loss and high saturation induction exceeding 1.5 T, however it shows relatively high permeability, limiting its energy storage capability.

Conventional avionic ignition systems can deposit very high energies (500 millijoules) into the spark, but typically operate at 10 Hz or less due to power consumption issues and also require DC—DC converters. They also have high rates of ignitor erosion, limiting the total duration of operation between ignitor changes and precluding their being operated continuously.

SUMMARY OF THE INVENTION

The present invention provides an ignition system containing a magnetic core-coil assembly and associated driver electronics. The system is capable of high pulse rate operation because of its rapid charge time (for example, ~100 microseconds using a 12 volt source), rapid voltage rise (for example, 200–500 nanoseconds), and rapid discharge time (for example, ~150 microseconds). It has low output impedance (30–100 ohms), produces high (>25 kV) open circuit voltages, and delivers high peak current through the spark (0.4–1.5 ampere) and high spark energy, typically 6–12 millijoules per pulse. Operation from a 12 volt battery source is readily accomplished using simple driver electronics at rates ranging from single shot to about 4 kHz, which are considerably greater than the current ignition systems can offer. The core-coil assembly may actually be operated using any voltage >5 volts to supply the driver electronics input voltage. The upper voltage supply limit is dependent on the voltage rating of the components used within the driver electronics, so the present system may be operated with conventional 12 V power or with readily available components at higher supply voltages including the 40–50 Volt system now being contemplated within the automotive industry. The charging time of the core-coil assembly is related to the supply voltage of the driver electronics. The higher the supply voltage, the faster the current will increase through the primary winding of the core-coil. This is due to loss reduction in the components that comprise the driver electronics and the ability to source more current. At lower voltages, the voltage drop across the switching element of the driver electronics (typically an IGBT) will limit the available voltage drop across the core-coil. This has the effect of increasing the charge time until a pre-determined current is flowing through the core-coil primary. This type of electronic system (electronic driver plus core-coil) output delivered through a surface gap plug (typical of avionic spark ignition systems) or a conventional J gap spark plug or derivatives results in a high power ignition source with localized heating capability. A "spark plug" or alternative term "ignitor" refers to a device that requires high voltage to create a spark across a gap. That gap can be a ceramic which is typical of a surface gap ignitor, or it can be an air gap, which is typical of a "J" gap spark plug. A "J" gap derivative refers to any other type of spark plug where an arc must be created over a distance similar to the distance between electrodes of a conventional "J" gap spark plug.

The magnetic core-coil assembly and ignition system of the invention may be operated at much higher pulse rates than prior art systems. The high pulse rates have a number of advantages applicable both to turbine and to diesel engines. Avionic systems are capable of high energy per spark but typically achieve only a 10 Hz rate. In the case of turbine engines fuel is burned substantially continuously. During engine start-up an ignition source must be provided. This source may advantageously employ an ignition system with a very high pulse rate, such as the 4 kHz or more that the present system can provide. The system is generally operated asynchronously, that is, spark activation is not synchronized to the position of other moving parts in the engine. After the engine is running continuously, the ignition system may be turned off, since the fuel burning is normally self-sustaining. However, in applications such as aerospace, safety considerations may dictate that the ignition system be activated at least periodically to insure the engine continues to run despite adverse conditions. For example, the intake of moisture into an aircraft turbine propulsion engine can cause a flameout, that is the quenching of the self-sustaining reaction, necessitating an engine re-start. For example, a gas turbine engine may flame out when an aircraft flies through rain. To avoid this, the ignition system may periodically be activated during known adverse conditions. However, the high Coulombic transfer of energy in a conventional system results in very rapid erosion of spark ignitors, thereby limiting the duty cycle and extent of the periodic activation of the system. In contrast, the present system experiences substantially slower rates of ignitor degradation, so the extra ignition can be used much more liberally, enhancing flight safety without the risk of ignitor failure.

The high pulse rate arc obtainable with the present system can also act as a localized heating source that can be activated essentially instantaneously, thus representing a cost effective replacement for glo-plugs in some applications such as diesel engines. The high pulse (>300 pulses per second) rate arc can create a greater heating of the fuel droplets or gas since the amount of total energy in the multiple arcs can exceed that of a conventional ignition system which is limited to approximately 110 pulses per second. In a diesel automotive or truck vehicle application, the engine may thus be started essentially on demand without the waiting time for a glo-plug to heat. In addition, a smaller battery may be used, since the total energy required for glo-plug heat up is much greater than the present system uses in start-up.

Generally stated, the magnetic core-coil comprises a magnetic core consisting of a ferromagnetic amorphous metal alloy. The core-coil assembly has a single primary coil for low voltage excitation and a secondary coil for a high voltage output. A number of core forms are possible, including both a single core with a single primary and a single secondary and a multiple core form such as the core included in the magnetic core-coil assembly described in detail in U.S. Pat. No. 5,844,462 which is assigned to the assignee of the present application and is hereby incorporated by reference into this disclosure. The latter core-coil version is known to those in the art as a pencil coil and will be referred to as such in this disclosure. This assembly has a secondary coil comprising a plurality of core sub-assemblies that are simultaneously energized via the common primary coil for a time during which current flows in the primary, storing energy in a magnetic field within the core material. The core sub-assemblies are adapted, when energized by the driver electronics, to produce secondary voltages. That is to say, during the period that the sub-assemblies are energized by the driver electronics, the primary current is rapidly interrupted, causing the magnetic field within the cores to collapse. Secondary voltages are thereby induced across the each of the secondary windings. These secondary voltages are additive in the pencil coil design, and the voltage is fed to the spark plug via the secondary connection to the spark plug or ignitor.

The single core-coil embodiment has a single primary and a single secondary but operates similarly. Energy is stored in the magnetic core as a result of current flowing through the primary. When the primary current flow is rapidly interrupted by the driver electronics, the magnetic field within the core collapses. A voltage is thereby induced and appears across the single secondary, which is connected to the spark plug or ignitor.

Compared to cores made with prior art materials, cores of the invention made with ferromagnetic amorphous metal alloy require fewer primary and secondary windings due to the magnetic permeability of the core material and exhibit lower magnetic losses. As thus constructed, the core-coil assembly has the capability of generating a high voltage in the secondary coil within a short period of time following excitation thereof.

More specifically, the core consists of an amorphous ferromagnetic material which exhibits high saturation magnetization, low core loss and a permeability ranging from about 100 to 500. The lower the core's permeability, the higher the energy that can be stored in the magnetic field and made available to be converted into spark energy, but also the higher the required magnetomotive force (amp-turns) and, hence, current. The magnetic properties recited are especially suited for rapid firing of the plug. Misfires due to soot fouling are minimized. Moreover, energy transfer from coil to plug is carried out in a highly efficient manner, with the result that very little energy remains within the core after discharge. The low secondary resistance of the toroidal design (<100 ohms) allows the bulk of the energy to be dissipated in the spark and not in the secondary wire. In a pencil coil design, a multiple toroid assembly is created that allows energy storage in the sub-assemblies via a common primary governed by the inductance of the sub-assembly and its magnetic properties. A rapidly rising secondary voltage is induced when the primary current is rapidly decreased. The individual secondary voltages across the sub-assembly toroids rapidly increase and add sub-assembly to sub-assembly, based on the total magnetic flux change of the system. This provides for a versatile arrangement in which several sub-assembly units are combined. The sub-assembly units are wound using existing toroidal coil winding techniques to produce a single assembly with superior performance in cases where physical dimensions are critical.

Another embodiment uses a single larger toroidally wound core-coil that produces output characteristics similar to those of the pencil coil (multiple stack arrangement of smaller core-coil assemblies) described above. The unit operates in the manner described above. Use of a single core is attractive because of its simpler manufacture and the typically lower resistance of the windings for a given core cross-sectional area.

The driver electronics comprise a power source (typically a battery), a low Equivalent Series Resistance (ESR) capacitor to supply high peak current, a switch such as an Integrated gate bipolar transistor (IGBT) which can be turned on (shorted condition) to allow current to flow through the coil primary establishing the magnetomotive force and then subsequently turned off (open condition) which rapidly decreases the current flow through the primary of the coil causing the magnetic field to collapse in the core inducing voltage onto the secondary winding producing an output. A timing means may be required to turn the switch on and off at the appropriate times.

BRIEF DESCRIPTION OF THE DRAWINGS

The invention will be more fully understood and further advantages will become apparent when reference is made to the following detailed description of the preferred embodiments of the invention and the accompanying drawings, in which:

FIG. 4 also contains two versions of the core, FIG. 4A depicts a gapped core while FIG. 4B depicts a distributed gap core;

DETAILED DESCRIPTION

Figure 1:
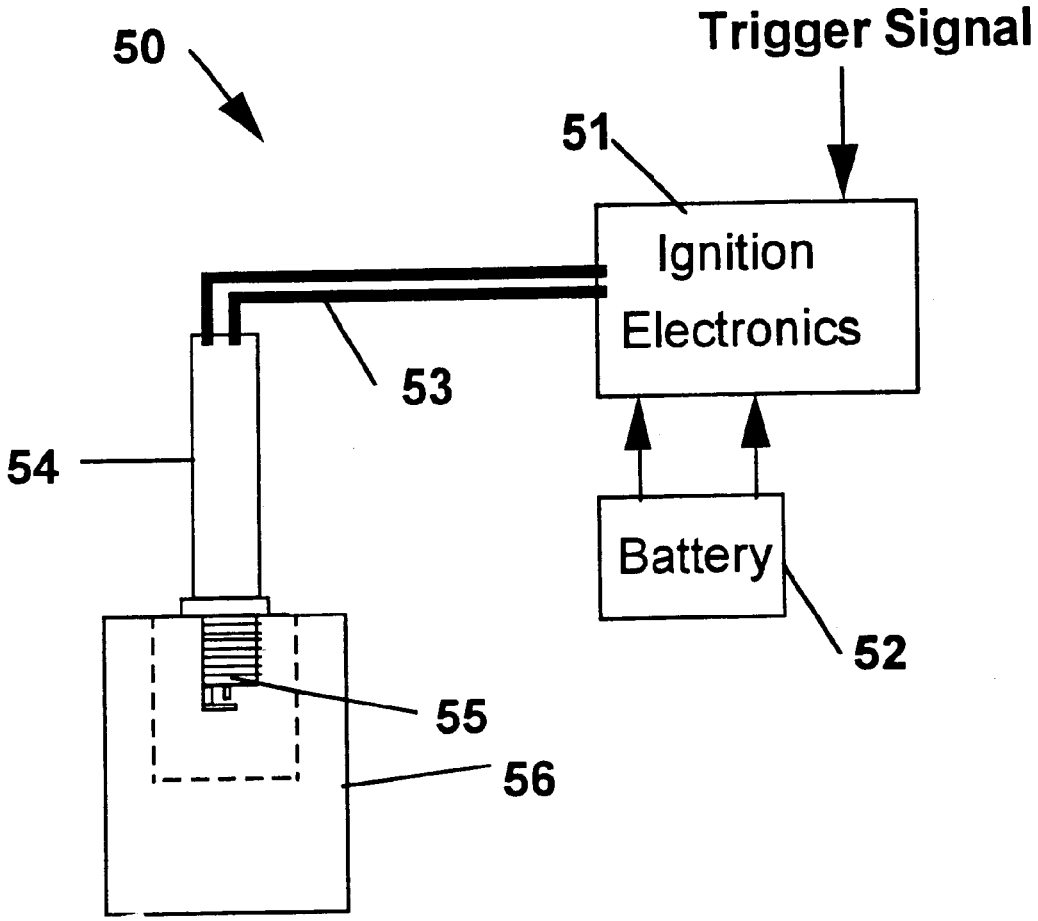
FIG. 1 is a schematic drawing of an ignition system depicting the core-coil assembly located on top of a spark plug and the driver electronics boxes.

Referring to FIG. 1 of the drawings, a power source battery 52 supplies power to the ignition electronics 51. Wires 53 carry the low voltage signal to the core-coil assembly 54. The wire pair 53 can also be a coaxial wire set. The core-coil assembly 54 is the embodiment depicted in FIG. 4, but could also be the embodiment depicted in FIG. 3. The core-coil assembly 54 can, alternatively, be located at an intermediate point such as with the ignition electronics 51, in which case the wires 53 carry high voltage signals to the spark plug 55. Another alternative location for the core-coil assembly is between the ignition electronics 51 and the spark plug 55, at which location the wires 53 would be low voltage carriers on the ignition electronics 51 side and high voltage carriers on the spark plug 55 side. The spark plug 55 shown in FIG. 1 has a J gap, but it could also be a surface gap plug or a J gap derivative as previously described. An ignition area, enclosed by the container 56, represents the diesel cylinder or the typical combustor case for a gas turbine engine. FIG. 1 is meant to illustrate the manner in which our invention might be utilized.

Figure 2:
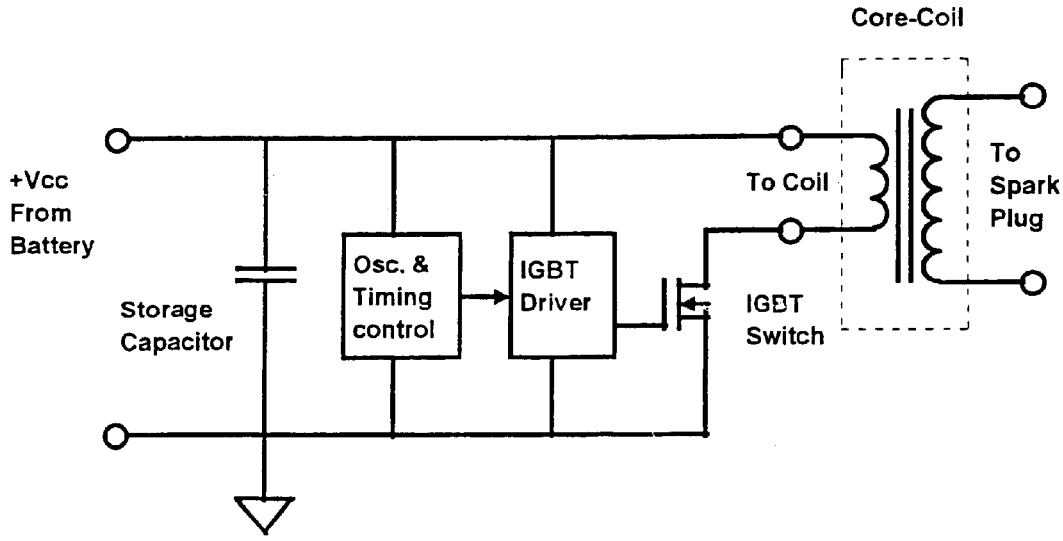
FIG. 2 is a circuit diagram for an electronic driver suitable for use with the core-coil assembly of the present invention.
Figure 3:
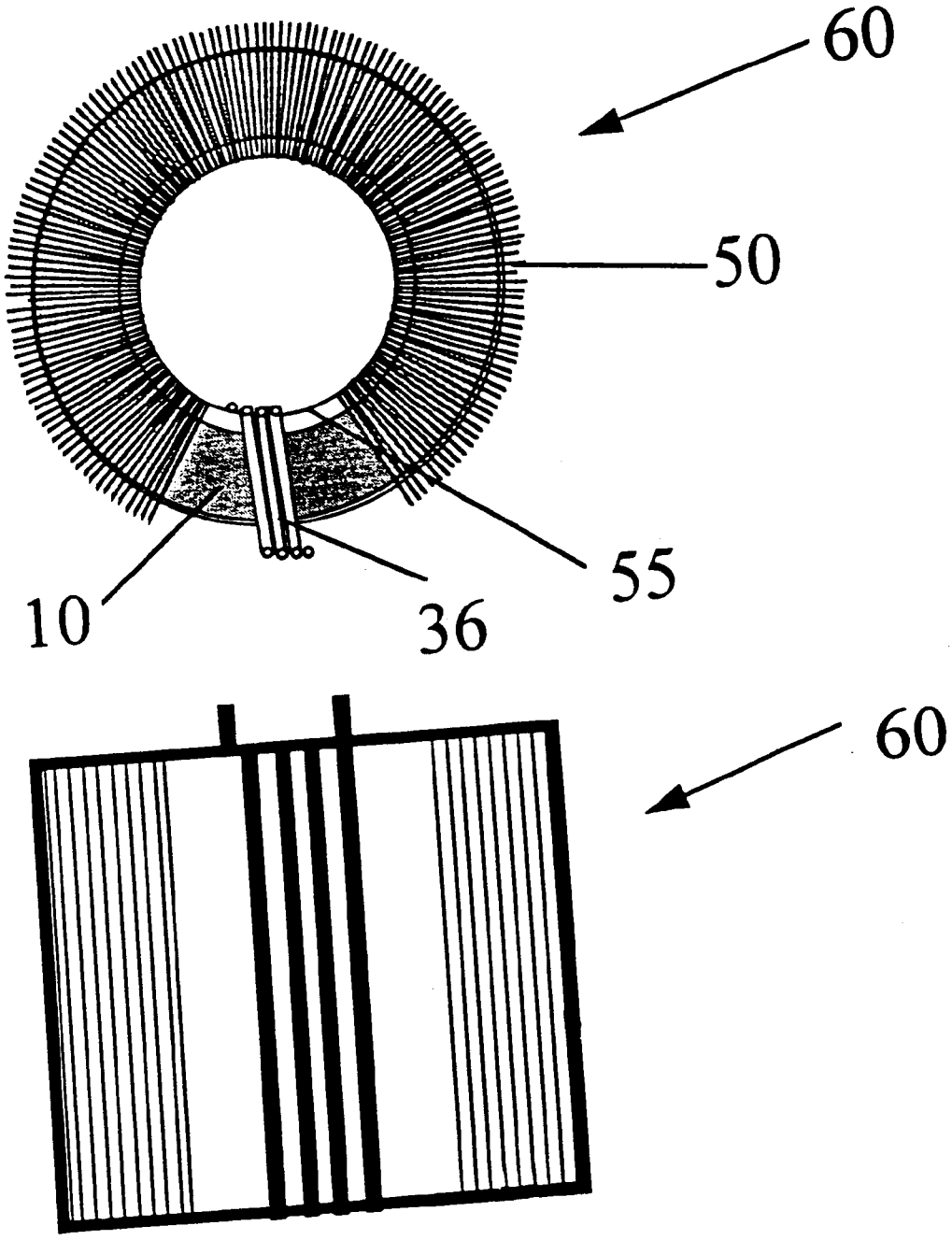
FIG. 3 is an assembly procedure guideline drawing showing the assembly method and connections used to produce one form of core-coil assembly.

Referring to FIG. 3, the core-coil assembly 60 comprises a toroidal magnetic core 10 consisting essentially of a ferromagnetic amorphous metal alloy contained within an insulating cup 55. A plurality of primary windings 36 (typically 3 to 10) are wound around the toroid, together with a plurality of turns (typically 100 to 400) of secondary wire 50. Adequate space is allowed between the primary and secondary windings for high voltage output considerations. Typically the secondary is arranged such that the voltage that is delivered to the center electrode of the spark plug is negative. The primary 36 has a low voltage excitation that arises from a current passing through the primary 36 when a switch is closed. This creates a magnetic field inside the ferromagnetic amorphous metal alloy 10 storing energy. Upon opening of the switch, the magnetic field inside the ferromagnetic amorphous metal alloy 10 collapses, thereby inducing a high voltage across the secondary winding 50. Referring to FIG. 2, the driver electronics 70 has an energy storage capacitor 72, which is charged to voltage Vcc 71, typically by a 12 volt battery. A timing control circuit 73 controls (i) the amount of time that the IGBT switch is closed, (ii) when it is opened and (iii) the pulse rate of the system. This timing signals the IGBT driver 74 to turn on, which closes the IGBT switch 75, permitting current to flow from the capacitor 72 through the core-coil assembly 76 (current flows through the primary) and through the IGBT 75. Current flowing through the core-coil assembly 76 (primary) causes a magnetomotive force to be applied to the ferromagnetic amorphous metal toroid inducing magnetization therein, and hence storing energy. Typical current values through the primary are in the 20–50 ampere range for times of 50–150 microseconds. The timing circuit 73 then opens the IGBT 75 through the IGBT driver 74, which causes current to rapidly decrease (typically <1 microsecond) through the core-coil assembly 76 (primary). This rapid reduction of current causes the magnetic field inside the core-coil assembly 76 to collapse, inducing a high voltage on the secondary of the core-coil assembly 76. The rate of voltage rise is typically a few hundred nanoseconds across the secondary of the core-coil assembly. The output of the core coil assembly 76 (secondary) is feed by leads 77 to the electrodes of a spark plug.

For asynchronous operation timing control circuit 73 further comprises an oscillator providing a series of signals setting the spark pulse rate. Timing control circuit 73 activates switch 75 repeatedly in response to each of these signals. For synchronous operation an ignition timing signal, such as a timing pulse generated by a conventional crankshaft position sensor, is required to activate timing control circuit 73. Timing control circuit 73 may further comprise circuitry to generate a plurality of signals temporally linked to the ignition timing signal, with each signal of the plurality used to activate switch 75 thereby generating rapid multiple spark events synchronized to the ignition timing signal referenced above. These multiple spark events may be used, for example, for multiple ignition of the fuel within each ignition stroke of a reciprocating engine.

The magnetic core 10 of FIG. 3 is based on an amorphous metal having a high magnetic induction, as is exhibited by iron-base alloys. The core 10 to be used may be of several forms, including single core-coil or pencil coil arrangements. Furthermore the core 10 may be either gapped or non-gapped. A gapped core, shown in FIG. 4*a*, has a discontinuous magnetic section in a magnetically continuous path. One example of a gapped core 10 is a toroidal-shaped magnetic core having a small slit commonly known as an air-gap. The gapped configuration may be used when the permeability needed is considerably lower than the inherent permeability of the core material, as wound. The gapped form may also be used if the losses of an ungapped core with the required permeability would be excessive. The air-gap portion of the magnetic path reduces the overall permeability. A non-gapped core, shown in FIG. 4*b*, has a magnetic permeability similar to that of an air-gapped core, but is physically continuous, having a structure similar to that typically found in a toroidal magnetic core. The apparent presence of an air-gap uniformly distributed within the non-gapped core 10 gives rise to the term "distributed-gap-core". The distributed gap is believed to arise from magnetic discontinuities inherent in the two-phase microstructure of a partially recrystallized amorphous metal alloy. Both gapped and non-gapped designs function in this core-coil assembly 34 design of FIG. 4 and the core-coil assembly 60 of FIG. 3, and are interchangeable as long as the effective permeability is within the required range. Non-gapped cores 10 were chosen for illustrative purposes, however the present invention, as embodied in the modular design described herein, is not limited to the use of non-gapped core material.

An alternative embodiment for the core-coil assembly appointed to be driven by substantially the same driver electronics as those described in FIG. 2 is disclosed by U.S. Pat. No. 5,844,462, which is assigned to the same assignee as the present application, and which disclosure is hereby incorporated by reference.

Figure 4:
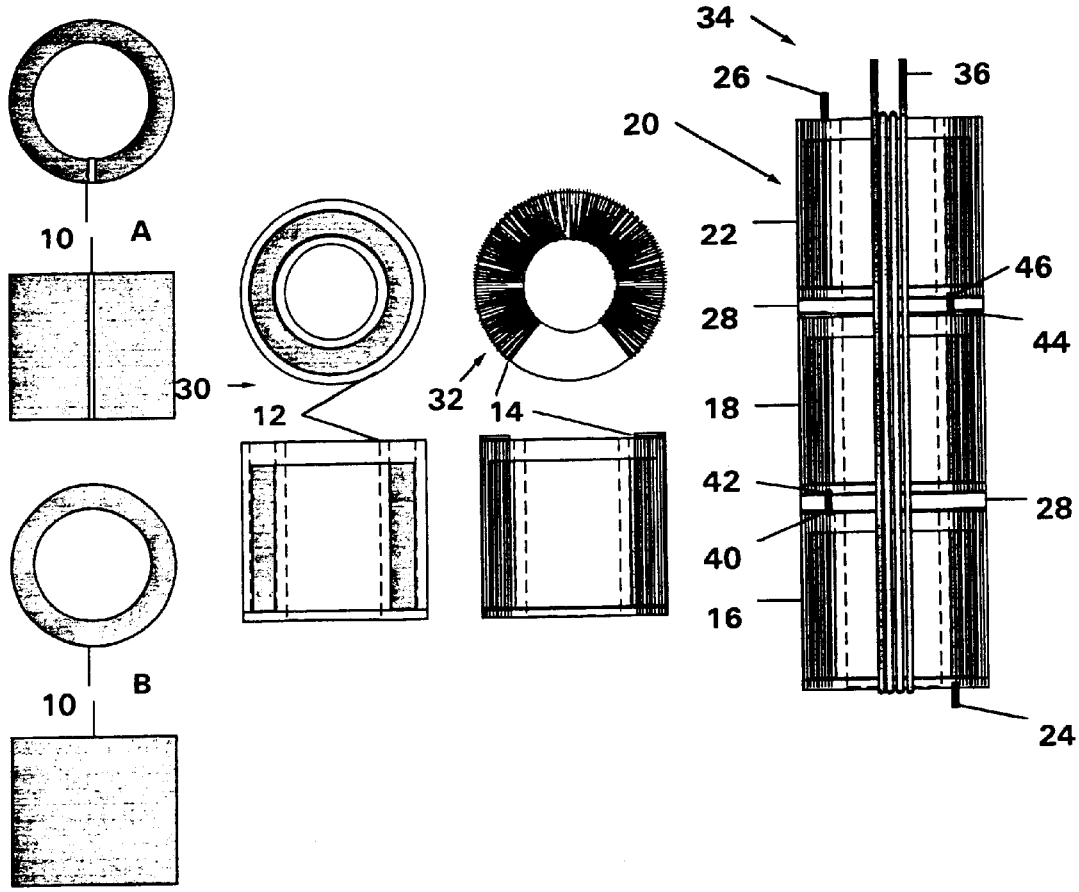
FIG. 4 is an assembly procedure guideline drawing showing for an alternative embodiment the assembly method and connections used to produce the stack arrangement, coil assembly of the present invention.

Referring to FIG. 4, the magnetic core-coil assembly 34 comprises a magnetic core 10 consisting of a ferromagnetic amorphous metal alloy. The core-coil assembly 34 has a single primary coil 36 for low voltage excitation and a secondary 20 which is comprised of the secondary coils of the core sub-assemblies 22, 18 and 16 linked in series for high voltage output. The core-coil sub-assemblies 22, 18 and 16 that are employed in forming the core-coil assembly 34 are simultaneously energized via the common primary coil 36. The core-coil sub-assemblies 32 are adapted, when energized, to produce secondary voltages that are additive, and are fed to a spark plug. As thus constructed, the core-coil assembly 34 has the capability of generating a high voltage in the secondary coil 20 (which is comprised of the combined secondary windings 14 of a plurality of core coil assembles 32 wired in series) within a short period of time following excitation thereof. Typically the secondary is arranged such that the voltage that is delivered to the center electrode of the spark plug is negative.

The magnetic core 10 is based on an amorphous metal having a high magnetic induction, including, for example, iron-base alloys. Two basic forms of a core 10 are suitable for use with our invention. They are gapped and non-gapped and are each of them is herein referred to as core 10. A gapped core, shown in FIG. 4*a,* has a discontinuous magnetic section in a generally continuous magnetic path. An example of such a core 10 is a toroidal-shaped magnetic core having a small slit commonly known as an air-gap. The gapped configuration is preferred when the permeability needed is considerably lower than the core's own permeability, as wound. An air-gap portion of the magnetic path reduces the overall permeability. A non-gapped core, shown in FIG. 4*b,* has a magnetic permeability similar to that of an air-gapped core, but is physically continuous, having a structure similar to that typically found in a toroidal magnetic core. The apparent presence of an air-gap uniformly distributed within the non-gapped core 10 gives rise to the term "distributed-gap-core". Such a distributed gap may be produced by a heat treatment that results in a duplex microstructure described in more detail elsewhere herein. Both gapped and non-gapped designs function in this core-coil assembly 34 design of FIG. 4 and the core-coil assembly 60 of FIG. 3 and are interchangeable as long as the effective permeability is within the required range. Non-gapped cores 10 were chosen for illustrative purposes, however the present invention, as embodied in the modular design described herein, is not limited to the use of non-gapped core material.

Numerous ferromagnetic amorphous metal alloys are suitable for manufacture of the magnetic core of the invention. Generally stated, these alloys are defined by the formula: $M_{70\text{-}85}Y_{5\text{-}20}Z_{0\text{-}20}$, subscripts in atom percent, where "M" is at least one of Fe, Ni and Co, "Y" is at least one of B, C and P, and "Z" is at least one of Si, Al and Ge; with the proviso that (i) up to ten (10) atom percent of component "M" can be replaced with at least one of the metallic species Ti, V, Cr, Mn, Cu, Zr, Nb, Mo, Ta, Hf, Ag, Au, Pd, Pt, and W, (ii) up to ten (10) atom percent of components (Y+Z) can be replaced by at least one of the non-metallic species In, Sn, Sb and Pb, and (iii) up to about one (1) atom percent of the components (M+Y+Z) can be incidental impurities. As used herein, the term "amorphous metallic alloy" means a metallic alloy that substantially lacks any long range order and is characterized by X-ray diffraction intensity maxima which are qualitatively similar to those observed for liquids or inorganic oxide glasses.

As is known in the art, a ferromagnetic material may further be characterized by its saturation induction or equivalently, by its saturation flux density or magnetization. The alloy suitable for use in the present invention preferably has a saturation induction of at least about 1.2 tesla (T) and, more preferably, a saturation induction of at least about 1.5 T. The alloy also has high electrical resistivity, preferably at least about 100 $\mu\Omega$-cm, and most preferably at least about 130 $\mu\Omega$-cm.

Suitable ferromagnetic amorphous metal alloys are commercially available, generally in the form of continuous thin strip or ribbon in widths up to 20 cm or more and in thicknesses of approximately 20–25 $\mu$m. These alloys are formed with a substantially fully glassy microstructure (e.g., at least about 80% by volume of material having a non-crystalline structure). Preferably the alloys are formed with essentially 100% of the material having a non-crystalline structure. Volume fraction of non-crystalline structure may be determined by methods known in the art such as x-ray, neutron, or electron diffraction, transmission electron microscopy, or differential scanning calorimetry. The alloy strip may be slit to a required width by ordinary techniques.

Highest induction values at low cost are achieved for iron-base alloys. For high thermal stability and ease of casting an alloy wherein "M" is iron, "Y" is boron and "Z" is silicon may be used. More specifically, it is preferred that the alloy contain at least 70 atom percent Fe, at least 5 atom percent B, and at least 5 atom percent Si, with the proviso that the total content of B and Si be at least 15 atom percent. Most preferred is amorphous metal strip having a composition consisting essentially of about 11 atom percent boron and about 9 atom percent silicon, the balance being iron and incidental impurities. This strip, having a saturation induction of about 1.56 T and a resistivity of about 137 $\mu\Omega$-cm, is sold by Honeywell International Inc. under the trade designation METGLAS® alloy 2605SA-1.

As is known in the art, core loss is that dissipation of energy which occurs within a ferromagnetic material as the magnetization thereof is changed with time. The core loss of a given magnetic component is generally determined by cyclically exciting the component. A time-varying magnetic field is applied to the component to produce therein a corresponding time variation of the magnetic induction or flux density. For the sake of standardization of measurement, the excitation is generally chosen such that the magnetic induction varies sinusoidally with time at a frequency "f" and with a peak amplitude "$B_{max}$." The core loss is then determined by known electrical measurement instrumentation and techniques. A number of standard protocols for carrying out these determinations of core loss, such as those published as ASTM Standards A912-93 and A927(A927M-94). Core loss is conventionally reported as watts per unit mass or volume of the magnetic material being excited.

Use of a low core loss material improves the efficiency of the ignition system and reduces the undesirable production of heat in the core-coil assembly disclosed herein. The loss of the core-coil assembly of the invention is as low as 100 W/kg of magnetic material when measured at room temperature with excitation at a frequency of 100 kHz to a peak sinusoidal flux density of 0.1 tesla. The loss applies either to gapped or ungapped cores disclosed herein. In some embodiments the loss may be 65 W/kg measured under the listed test conditions.

The magnetic properties of the amorphous metal strip appointed for use in the magnetic core of the present invention may be enhanced by thermal treatment. A magnetic field may optionally be applied to the strip during at least a portion, such as during the cooling portion, of the heat treatment. This heat treatment (also termed, annealing) may be carried out at a temperature and for a time that enhances the magnetic properties of the strip without altering its substantially fully glassy microstructure.

Alternatively, the heat treatment may be carried out at a sufficiently high temperature near the crystallization temperature of the alloy and for long enough that some portion of the initially glassy microstructure is transformed into a crystalline material. The production of this multi-phase microstructure reduces the permeability of the alloy material and increases its core loss somewhat. Some reduction in permeability is advantageous in the present application because it increases the amount of energy stored in the core when magnetized. However excessive core loss would undesirably heat the magnetic core and thus reduce the overall efficiency of the ignition system. Even though lower permeability cores store more energy magnetically, their higher core losses also act to limit the energy ultimately delivered in the spark event. It thus has been found that core permeabilities in the 250 to 500 range for ungapped cores deliver maximal spark energy. It has been found that tape wound toroids of iron-base alloys may be heat treated to a permeability as low as about 250 while maintaining a low core loss that may be about 65 W/kg or less when measured at room temperature with excitation at a frequency of 100 kHz to a peak sinusoidal flux density of 0.1 tesla. This permeability level may be achieved by partial recrystallization without requiring that the toroid be gapped. For some applications an ungapped core may have a permeability as low as about 180 with loss below about 100 W/kg, measured similarly at 100 kHz with a peak flux density of 0.1 T. Lower permeability values, for example as low as 100, may be obtained in combination with low core loss by methods such as gapping the core. The permeability of a gapped core is controlled by a combination of the size of the gap and the intrinsic permeability of the magnetic material used.

Figure 8:
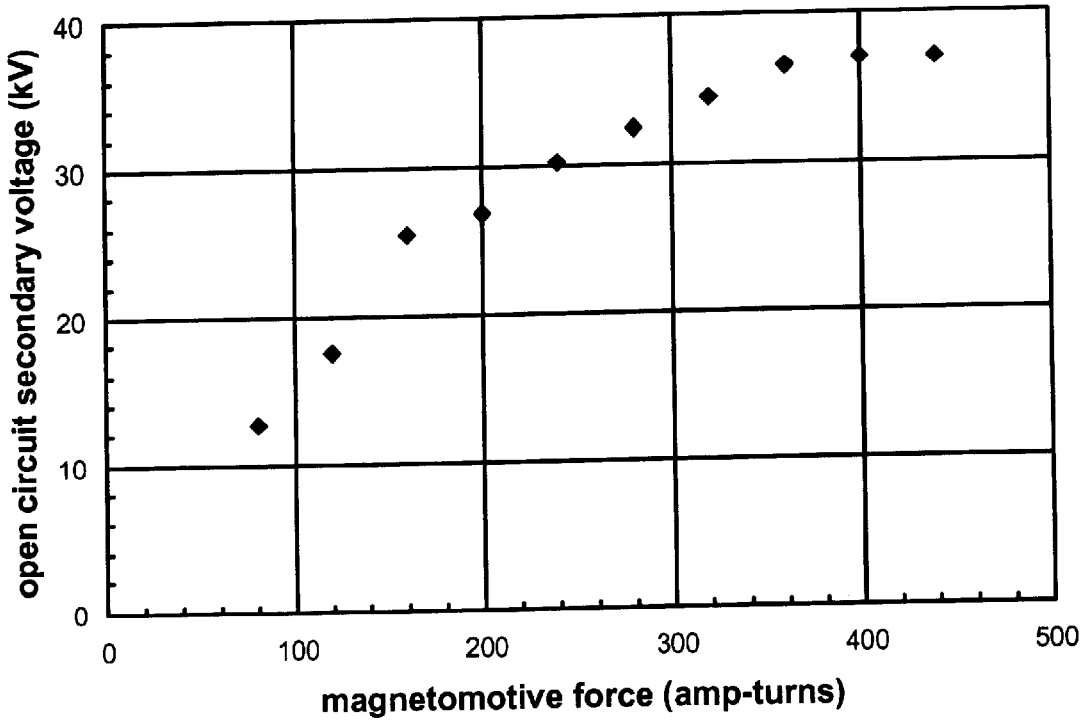
FIG. 8 depicts the relationship between open circuit secondary voltage and magnetomotive driving force for a magnetic core to be used in an embodiment of the present invention.

Referring to FIG. 8, there is depicted the relationship between core loss (measured with 100 kHz sinusoidal flux excitation to an induction of 0.1 T) and permeability of tape-wound toroids of ferromagnetic amorphous $Fe_{80}B_{11}Si_9$ alloy suitable for use in the magnetic core of the present invention.

The non-gapped core 10 is made of an amorphous metal based on iron alloys and processed so that the core's magnetic permeability is between 100 and 500 as measured at a frequency of approximately 1 kHz. To improve the efficiency of non-gapped cores by reducing eddy current losses, shorter cylinders are wound and processed and stacked end to end to obtain the desired amount of magnetic core referred to as a segmented core. This segmented core has the same amount of material that a non-segmented core contains, but instead of a single core, it is comprised of several shorter cores forming the identical overall shape and size. Leakage flux from a distributed-gap-core is much less than that from a gapped-core, emanating less undesirable radio frequency electromagnetic interference (EMI) into the surroundings. It is noteworthy that EMI may be particularly deleterious to communication and navigational systems in a ship, aircraft, or land-based vehicle.

An output voltage at the secondary winding 20 greater than 10 kV for spark ignition is achieved by a non-gapped core 10 with less than 60 Ampere-turns of primary 36 and about 110 to 160 turns of secondary winding 20. As used herein the term "Ampere-Turns" means the value of the current in Amperes multiplied by the number of turns that comprise the primary. A value such as 60 ampere-turns as used above means that with a 4 turn primary, there is 15 amperes of current flowing in the primary at the time that the current is interrupted in the primary. Typical turn off times for interrupting the primary are on the order of 1 microsecond from the driver electronics.

Designs of the type depicted in FIG. 3 have open circuit outputs in excess of 25 kV obtained with <120 Ampere-turns when energized by the driver electronics. It is not a requirement for successful practice of our invention that the specific dimensions used in the examples be directly adhered to. Large variations of design space exist according to the input and output requirements.

Upon final construction, the right circular cylinder formed the core of a toroid. Insulation between the core and wire was achieved through the use of high temperature resistant moldable plastic which also doubled as a winding form facilitating the winding of the toroid. Fine gauge wire (approximately 36 gauge) was used to wind the required 100–400 secondary turns. Since the output voltage of the coil could exceed 25 kV, which represents a winding to winding voltage in the 80 volt range for a 300 turn secondary, the wires could not be significantly overlapped. The best performing coils had the wires evenly spaced over approximately 300 degrees of the toroid. The remaining 60 degrees was used for the primary windings.

An alternative construction, shown in FIG. 4, also referred to as a pencil coil, breaks the original construction, shown in FIG. 3, down into a smaller component level structure in which the components can be routinely wound using existing coil winding machines. In principle, the construction of FIG. 4 takes core sections of the same amorphous metal core material of manageable size and unitizes them. This is accomplished by forming an insulator cup 12 into which core 10 may be inserted and treating that sub-assembly 30 as a core to be wound in the form of a toroid 32. The number of secondary turns 14 required is substantially the same as for the original design. The final assembly 34 comprises a stack having a sufficient number (1 or greater) of these structures 32 to achieve the desired output characteristics. Every other toroid unit 32 should be wound oppositely to facilitate the electrical connections between the sub-assemblies. This allows the output voltages to add.

A typical structure 34 of this embodiment using three sub-assemblies is shown in FIG. 4. It comprises a first toroidal unit 16 wound counterclockwise (ccw) with one output wire 24 acting as the final coil assembly 34 output. A second toroidal unit 18 is wound clockwise (cw) and stacked on top of the first toroidal unit 16 with a spacer 28 to provide adequate insulation. The bottom lead 42 of the second toroidal unit 18 is attached to the upper lead 40 (remaining lead) of the first toroidal unit 16. A third toroidal unit 22 is wound ccw and stacked on top of the previous two toroidal units 16, 18 with another spacer 28 for insulation purposes. The lower lead 46 of the third toroidal unit is connected to the upper lead 44 of the second toroidal unit. Although three toroidal units are depicted in FIG. 4, any total number of toroidal units 32 may be used as determined by design criteria and physical size requirements. The final upper lead 26 forms the other output of the core-coil assembly 34. Typically, lead 24 is connected to the center electrode of the spark plug and is at negative potential while lead 26 provides the return current path of the structure 34. The lead 24 end of the structure 34 is referred to herein as the bottom, since it typically rests on the top of the spark plug connecting it to the center electrode of the spark plug. The lead 26 end of the structure 34 is referred to herein as the top of the structure, since this is the location wherein the primary wires 36 are accessible. Secondary windings 14 of these toroidal units 32 are individually wound so that approximately 300 out of the total 360 degrees circumference for the toroid is covered. The toroidal units 32 are stacked so that the open 60 degrees of each toroid unit 32 are in approximate vertical alignment. A common primary 36 is wound through this core-coil assembly 34 onto the aligned open portions of the circumference of each subassembly. This construction is referred to herein as the stacker construction.

The voltage distribution around the single coil design resembles that of a variac with the first turn being at zero volts and the last turn being at full voltage. This voltage distribution is in effect over the entire height of the coil structure. The primary winding is kept isolated from the secondary windings and is located in the center of the 60 degree free area of the wound toroid. These lines are essentially at low potential due to the low voltage drive conditions used on the primary. The highest voltage stresses occur at the closest points of the high voltage output and the primary, the secondary to secondary windings and the secondary to core. The highest electric field stress point exists down the length of the inside of the toroid with field enhancement at the inner top and bottom of the coil. The stacker construction voltage distribution is slightly different. Each individual core-coil toroidal unit 32 has the same variac type of distribution, but the stacked distribution of the core-coil assembly 34 is divided by the number of individual toroidal units 32. If there are 3 toroidal units 32 in the core-coil assembly 34 stack, then the bottom toroidal unit 16 will range from V lead 24 to ⅔ V lead 40, with the voltage changing approximately linearly over the secondary windings from V at lead 24 to ⅔ V at lead 40, the second toroidal unit 18 will range from ⅔ V lead 42 to ⅓ V lead 44, with the voltage changing approximately linearly over the secondary windings from ⅔ V at lead 42 to ⅓ V at lead 44, and the top toroidal unit 22 will range from ⅓ V lead 46 to 0 V lead 26, with the voltage changing approximately linearly over the secondary windings from ⅓ V at lead 46 to 0 V at lead 26, where lead 26 is referenced at zero voltage. This configuration lessens the area of high voltage stress and that V is typically negative. It is referred to as a stepwise voltage distribution from one sub-assembly to the next.

The output voltage waveform has a short pulse component (typically 1–3 microseconds in duration with a 100–500 ns rise time) and a much longer low level output component (typically 100–150 microseconds duration). The stacker arrangement voltage distribution is different and allows the highest voltage section to be located on the top or bottom of the core-coil assembly 34 depending on the grounding configuration. An advantage of the stacker construction is that the high voltage section can be placed right at the spark plug deep in the spark plug well. The voltage at the top of the core-coil assembly 34 maximizes at only ⅓ V for a 3 stack unit.

Magnetic cores composed of an iron-based amorphous metal having a saturation induction exceeding 1.5 T in the as-cast state were prepared. The cores had a cylindrical form with a cylinder height of about 15.6 mm and outside and inside diameters of about 17 and 12 mm, respectively. These cores were heat-treated with no external applied fields. FIG. 4 shows a procedure guideline drawing of the construction of a three stack core-coil assembly 34 unit. These cores 10 were inserted into high temperature plastic insulator cups 12. Several of these units 30 were machine wound cw on a toroid winding machine with 110 to 160 turns of copper wire forming a secondary 14 and several were wound ccw. The first toroidal unit 16 (bottom) was wound ccw with the lower lead 24 acting as the system output lead. The second toroidal unit 18 was wound cw and its lower lead 42 was connected to the upper lead 40 of the lower toroidal unit 16. The third toroidal unit 22 was wound ccw and its lower lead 46 was connected to the upper lead 44 of the second toroidal unit 18. The upper lead 26 of the third toroidal unit 22 acted as the ground lead. Plastic spacers 28 between the toroidal units 16, 18, 22 acted as voltage standoffs. The non-wound area of the toroidal units 32 was vertically aligned. A common primary 36 was wound through the core-coil assembly 34 stack in the clear area. This core-coil assembly 34 was encased in a high temperature plastic housing with holes for the leads. This assembly was then vacuum-cast in an acceptable potting compound for high voltage dielectric integrity.

The core coil assembly may be potted (encapsulated) inside a housing to prevent high voltage arcing. In operation, the assembly is required to hold off the open circuit voltage internally for a prolonged period of time over widely varying environmental conditions. The open circuit voltage is the highest voltage encountered by the system. Such voltage must be held off during operation over a substantial number of years during which temperatures may vary over wide extremes which are at least from −40° C. to +150° C. and possibly wider, especially in aerospace applications. It is also desired that the unit be relatively resistant to chemicals typically found in the engine environment.

There are many alternative types of potting materials. The basic requirements of the potting compound are that it possess sufficient dielectric strength, that it adhere well to all other materials inside the structure, and that it be able to survive the stringent environment requirements of cycling, temperature, shock and vibration as noted above. It is also desirable that the potting compound have a low dielectric constant and a low loss tangent. The housing material should be injection moldable, inexpensive, possess a low dielectric constant and loss tangent, and survive the same environmental conditions as the potting compound.

There are numerous potting and housing materials that have been used by ignition system manufacturers in the past. For automotive applications, the potting compound, housing material and items to be encapsulated have sometimes been thermally matched (roughly the same coefficients of thermal expansion or CTE) by adding fillers such as glass fiber and/or minerals to the potting and housing materials. The purpose was to reduce the stress and strain from differential expansion between the various materials in the system over the operating temperature extremes encountered. However, the addition of the glass fiber and/or minerals typically raises the dielectric constant of the material. Typical potting compounds used in conventional construction are two component anhydrous epoxy formulations that exhibit excellent adhesion to the housing and its internal components along with high temperature electrical performance and good thermal shock resistance. In order to match the CTE's of the materials over a wide temperature range, the epoxy is formulated to have a glass transition temperature ($T_g$) set as close as practical to the maximum expected operating temperature. The housing material is typically made of a rugged thermoplastic polyester which is glass fiber filled, has a high $T_g$ and a CTE matched to the epoxy. One conventional housing material is sold by Hoescht Celanese under the trade name Vandar. The glass and/or mineral filling in such a thermoplastic polyester creates a harder, stiffer material.

The need for careful selection of materials is especially great when the invention is practiced with the stacker configuration. This "pencil" coil geometry is characterized by a coil assembly which has a large ratio of stack height to diameter. In this implementation this large aspect ratio can lead to a great deal of internal stress being built up inside the coil if the CTE are not matched quite closely. That match is difficult to achieve with differing materials over a nearly 200° C. operating range. In a typical design, the outer section of the active components (toroidal cups) is located very close to the inner wall of the housing. The potting compound effectively solidifies the parts together pinning the outer area of the components to the wall due to the large surface area of the cups and the inner wall of the housing. In a toroidally wound unit, there is a long section of potting compound that fills the void between the bottom and top of the core-coil assembly up through the center of the core-coil assembly. The diameter of that column is related to the design of the toroid and winding equipment. Due to the long length of that column and the sealed bottom of the core-coil assembly, a large shear force can exist between this column of potting compound and the toroidal cups. Typical two part epoxy potting compounds are very hard and inflexible and adhere very well to the housing plastic. In this situation, a large shear stress can de-laminate the housing material outer skin from the main body of the material, forming a crack that can bridge the primary and secondary. This occurs since the skin is resin rich and has an underlying layer with glass fiber and or mineral content. Both components are very stiff, but the toroidal cups, composed of housing material typically exhibit a lower yield strength, so they de-laminates first. This can result in an internal voltage arc that shorts the primary and secondary before useful voltage output can be obtained from the core-coil. The stress that creates this problem is typically due to the very large thermal operating range of the core coil (−40° C. to +150° C.) and large thermal gradients that can occur from thermal shock.

A solution to this problem is to use alternative potting and housing materials that are more compliant. These types of materials create far less shear stress since the materials yield and deform. A potting compound designed for electrical components that satisfies this criterion is a two part elastomeric polyurethane system such as Epic S7207. Such materials feature a high dielectric strength, a hardness in the mid Shore A range, and a low dielectric constant. The $T_g$ for the Epic material is about −25° C. and the CTE is $209\times10^{-6}$ cm/cm/° C. This material is soft, compliant and elastically deformable. Materials of this type typically exhibit low $T_g$'s compared to two component epoxies and have much larger CTEs since they are used above the $T_g$ point. Another suitable potting material is a two part silicone rubber compound such as S-1284 sold by Castall. One housing material that possesses good thermal characteristics and is compliant is Lemalloy PX603Y produced by Mitsubishi Engineering Plastics. Lemalloy is a PPE/PP (polyphenylene ether/polypropylene) blend that is flexible, has a low dielectric constant, good electrical properties, good chemical resistance and is injection moldable. The material is only very slightly crystalline, but exhibits good and stable mechanical properties. Such material and other materials like it, including polymethylpentene/polyolefin blends and polycylcolefin/polyolefin blends, are high use temperature polymers. The Lemalloy material and a two part elastomeric polyurethane potting compound bond together very well under conditions wherein the surfaces have been properly prepared and plasma cleaned prior to potting. The preparation should include removal of contaminants such as oils, organics, and mold-release agents. Core-coil assemblies made from these materials and with these techniques are durable, having survived many thermal shock cycles form −40° C. to +150° C. in the pencil coil arrangement even though there is a very large CTE mis-match between components.

Figure 5:
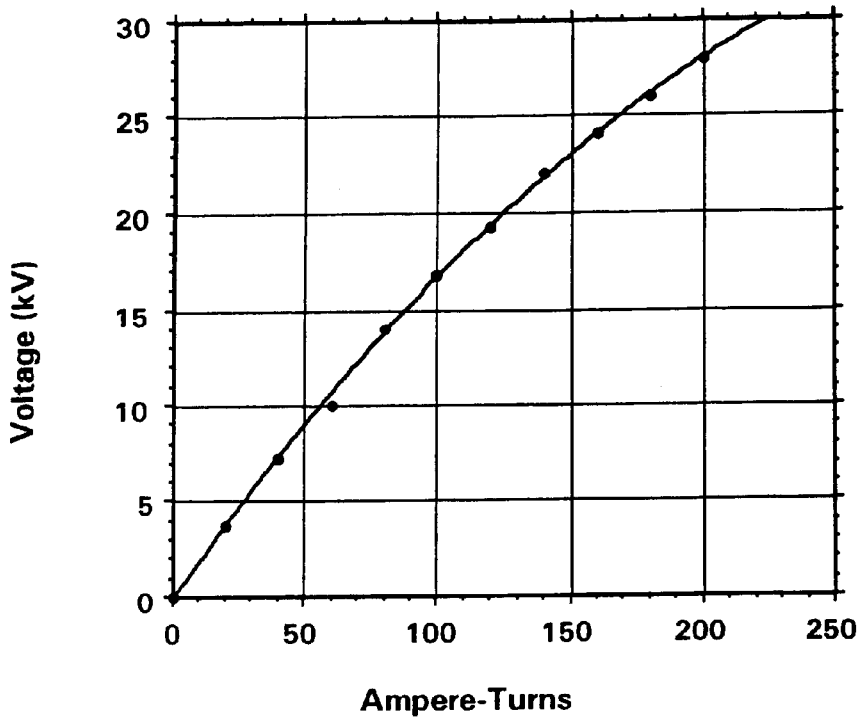
FIG. 5 is a graph showing the output voltage across the secondary for the Ampere-turns on the primary coil of the assembly shown in FIG. 4.
Figure 7:
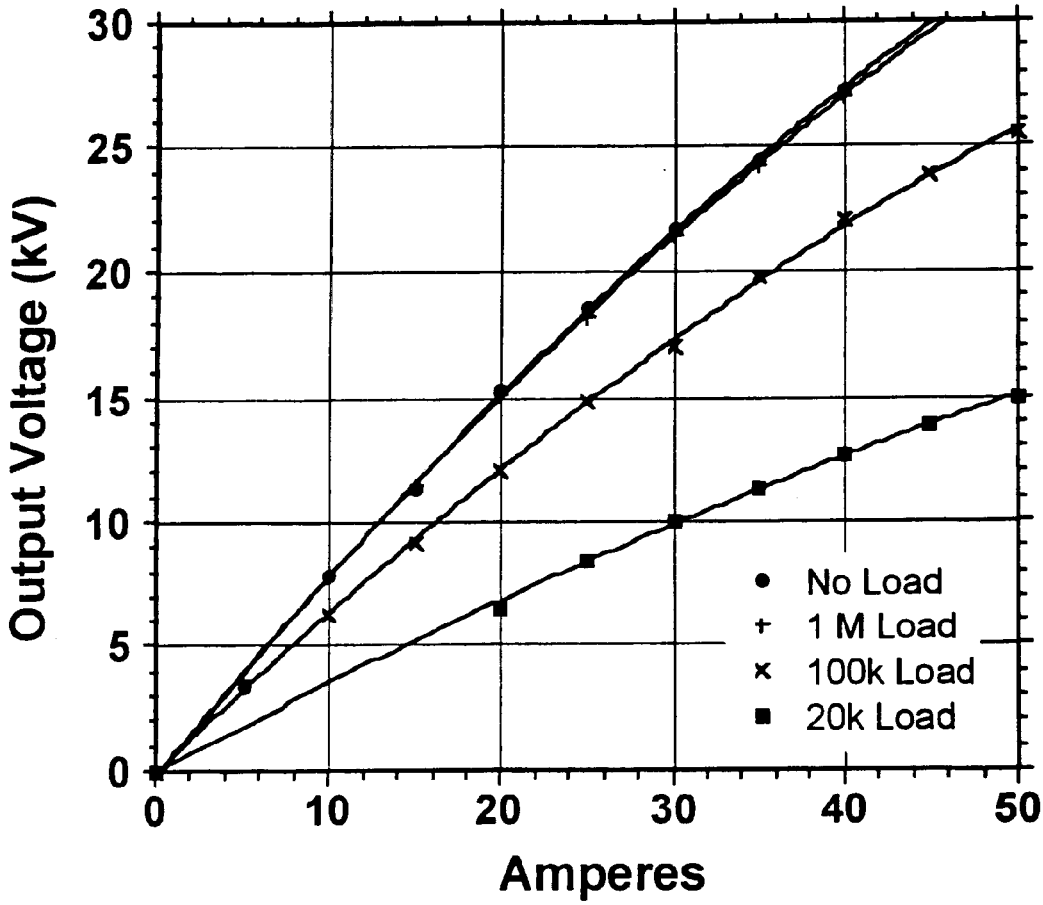
FIG. 7 is a graph showing the voltage reduction of the open circuit voltage as measured by placing resistance in parallel with the probe to simulate fouled spark plug conditions.

A current was supplied in the primary coil 36 of FIG. 4 by the driver electronics previously described, building up rapidly within about 25 to 100 μsec to a level up to but not limited to 60 amps. FIG. 5 shows the open circuit output voltage attained when the primary current was rapidly shut off in the driver electronics at a given peak Ampere-turn. The charge time was typically <120 microseconds with a voltage of 12 volts on the primary switching system, at which point the current flowing through the primary winding 36 was interrupted, which resulted in a rapidly rising voltage across the combinations of sub-assembly secondaries 32. The number of sub-assemblies were wired in series forming an effective secondary 20 across which the total voltage appeared. The output voltage had a typical short output pulse duration of about 1.5 microseconds FWHM and a long, low level tail that lasted approximately 100 microseconds. Thus, in the magnetic core-coil assembly 34, a high voltage, exceeding 10 kV, could be repeatedly generated at time intervals of less than 150 μsec. This feature was required to achieve rapid multiple sparking action such as the firing of a spark plug more than once during each combustion cycle of an internal combustion engine. Moreover, the rapid voltage rise produced in the secondary winding reduced engine misfires resulting from soot fouling. Soot fouling occurs when carbon from partially burned fuel deposits on the spark plug or ignitor surfaces. This acts as a shunt resistor in which current provided by the secondary of the core-coil may alternatively flow. This can greatly reduce the available voltage across the gap of the spark plug or ignitor. If soot fouling is too great due to excessive carbon buildup, there will be insufficient voltage generated across the gap to initiate a spark. One method of combating this problem is to create a coil with a much lower output impedance compared to a conventional coil. This core-coil's characteristics will have a very rapid output voltage rise time. The core-coil designs described in detail in this disclosure have this property. FIG. 7 plots the measured output voltage of the previously described core-coil as a function of shunt resistance. A severely fouled plug has a shunt resistance of approximately 100 kilohms. The output voltage noted in FIG. 7 at an operating primary current of 50 amperes would have decreased to about 25 kV from the no load condition. A conventional automotive ignition system would have exhibited an open circuit voltage of greater than 40 kV, but a 100 kilohm shunt condition output voltage decrease to about 5 kV under its normal excitation conditions.

The following examples are presented to provide a more complete understanding of the invention. The specific techniques conditions, materials, proportions and reported data set forth to illustrate the principles and practice of the invention are exemplary and should not be construed as limiting the scope of the invention.

EXAMPLES

Example 1

An amorphous iron-based ribbon having a width of about 1.0" and a thickness of about 20 $\mu$m was wound on a machined stainless steel mandrel and spot welded on the ID and OD to maintain tolerance. The inside diameter of 0.54" and the outside diameter was selected to be 1.06". The finished single cylindrical core weighed about 55 grams. The core was annealed in a nitrogen atmosphere in the 430 to 450° C. range with soak times from 2 to 16 hours. The annealed core was placed into an insulator cup and wound on a toroid winding machine with 300 turns of thin gauge insulated copper wire as the secondary and 6 turns of thicker wire for the primary. A design of the type depicted in FIG. 3 using an electronics driver as previously described produced open circuit voltages of >25 kilovolts with <120 Ampere-turns. It is not a requirement to directly adhere to the dimensions used in this example. Large variations of design space exist according to the input and output requirements. The final constructed right angle cylinder formed the core of an elongated toroid. Insulation between the core and wire was achieved through the use of high temperature resistant moldable plastic which also doubled as a winding form facilitating the winding of the toroid.

A pencil coil equivalent consists of an amorphous iron-based ribbon having a width of about 15.6 mm and a thickness of about 20 $\mu$m was wound on a machined stainless steel mandrel and spot welded on the ID and OD to maintain tolerance. The inside diameter of 12 mm was set by the mandrel and the outside diameter was selected to be 17 mm. The finished cylindrical core weighed about 10 grams. The cores were annealed in a nitrogen atmosphere in the 430 to 450° C. range with soak times from 2 to 16 hours. The annealed cores were placed into insulator cups and wound on a toroid winding machine with 140 turns of thin gauge insulated copper wire as the secondary. Both ccw and cw units were wound. A ccw unit was used as the base and top units while a cw unit was the middle unit. Insulator spacers were added between the units. Four turns of a lower gauge wire, forming the primary, were wound on the toroid subassembly in the area where the secondary windings were not present. The middle and lower unit's leads were connected as well as the middle and upper units leads. The assembly was placed in a high temperature plastic housing and was potted. With this construction, the secondary voltage was measured as a function of the primary current and number of primary turns, and is illustrated in FIG. 5.

Figure 6:
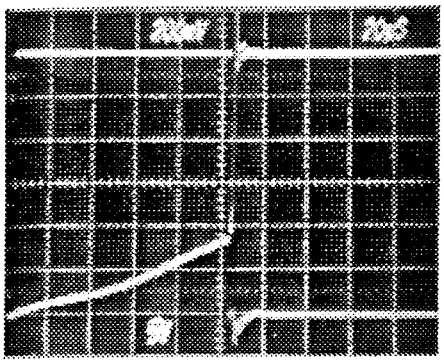
FIG. 6 is a typical voltage and current oscilloscope trace of the core-coil assembly of FIG. 4; whereas the second picture is a magnified view of the first picture.
Figure 6:
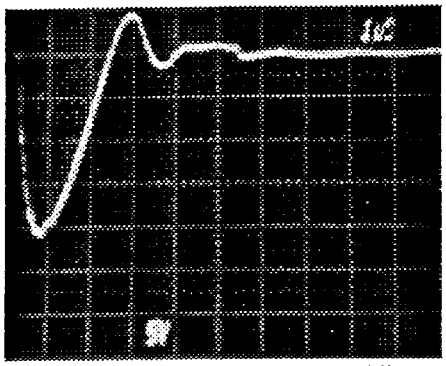

The driver electronics is the same as depicted in FIG. 2 where the voltage source is a 12 volt battery and the IGBT switch is closed for ~100 microseconds and then rapidly opened. A design of the type depicted in FIG. 4 produced open circuit voltages of >25 kilovolts with <175 Ampere-turns under these conditions. FIG. 6 shows two oscilloscope photographs, the first photograph showing the typical charging waveform (lower trace) of the primary core-coil current at 20 amperes/division in the vertical scale and 20 microseconds per division in the horizontal scale. When the current was rapidly decreased, the output voltage of the assembly rapidly increased. A probe was used to measure this signal and it is displayed as the upper trace of the first photo on a vertical scale of 5 kilovolts per division. The second photo is a time expansion of the initial voltage rise across the secondary on a horizontal time scale of 1 microsecond per division and a vertical scale of 5 kilovolts per division showing the rapid voltage rise. The output voltage was negative in this case and was thus displayed. FIG. 7 shows a graph of the output voltage as a function of ampere-turns of the coil with calibrated shunt resistance placed across the core-coil secondary. This method effectively loaded the secondary simulating a fouled spark plugs at significantly greater degrees of fouling. The output was graphed for the conditions of open circuit (no load) and shunt resistance of 1 megohm, 100 kilohm and 20 kilohms. These shunt resistance simulated fouled spark plugs with a 100 kilohm load representing an extremely fouled plug. The graphs indicate that a sizable percentage of the unloaded voltage can still be achieved across the secondary.

Example 2

Figure 9:
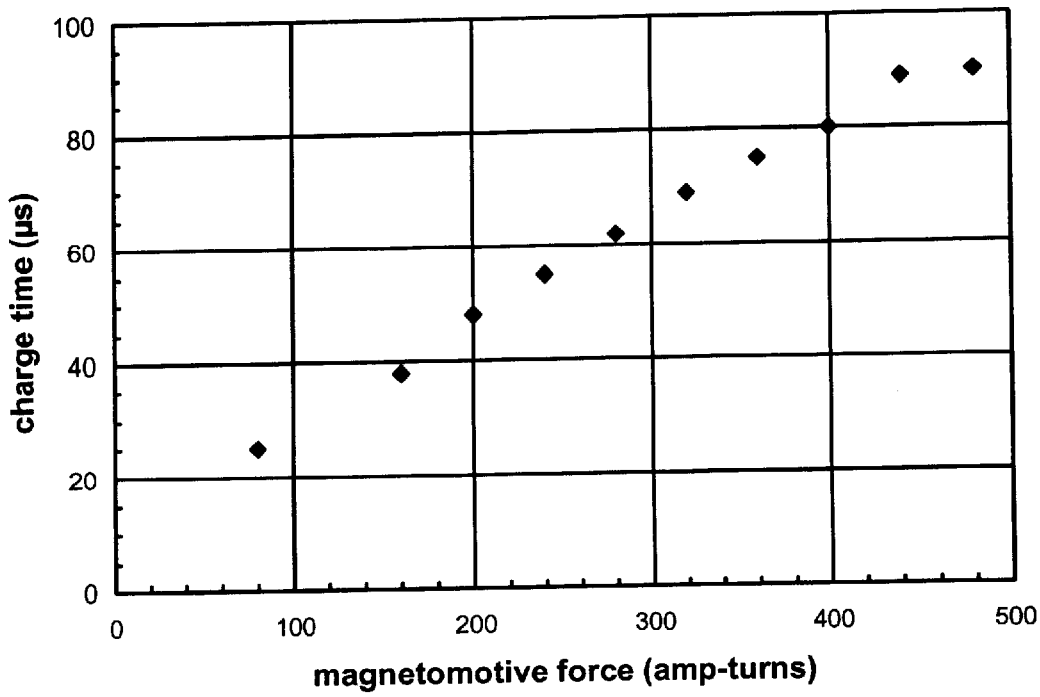
FIG. 9 depicts the relationship between charging time and magnetomotive driving force for a magnetic core driving a spark gap and to be used in an embodiment of the present invention.
Figure 10:
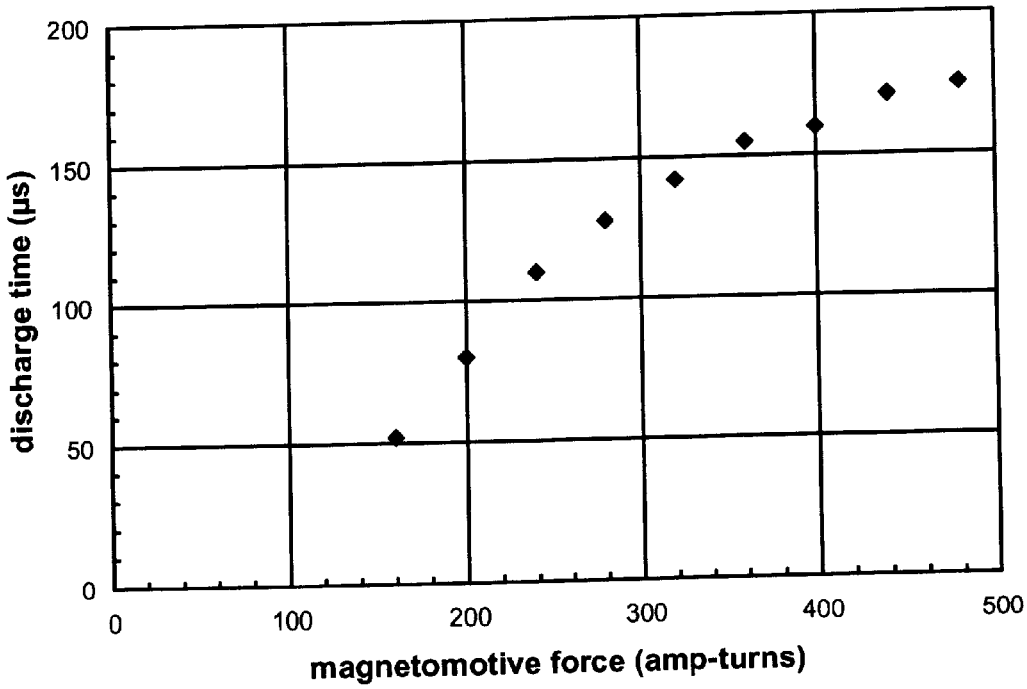
FIG. 10 depicts the relationship between discharge time and magnetomotive driving force for a magnetic core driving a spark gap and to be used in an embodiment of the present invention.
Figure 11:
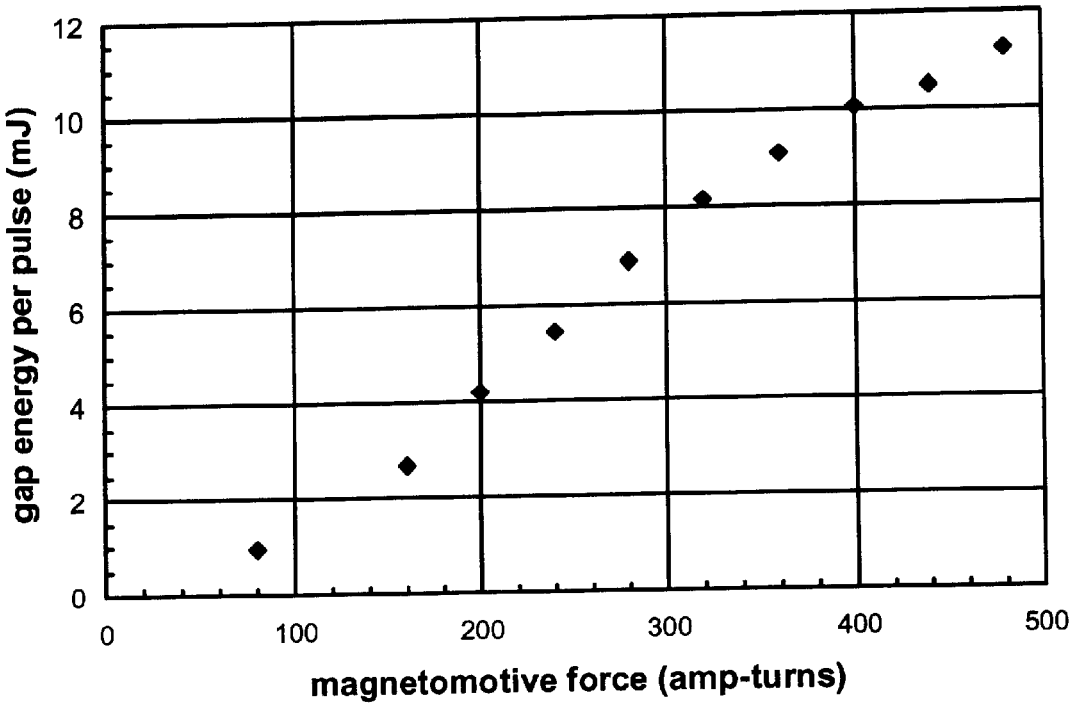
FIG. 11 depicts the relationship between energy delivered into a spark gap and magnetomotive driving force for a magnetic core to be used in an embodiment of the present invention.

Tape-wound toroidal cores were prepared using an iron-base, ferromagnetic amorphous alloy consisting essentially of a composition $Fe_{80}B_{11}Si_9$. For each core approximately 75 grams of ribbon having a width of about 19 mm was wound onto a mandrel with an 18 mm diameter. The ribbon of each core was spot-welded at both the inner and outer diameters and the core removed from its mandrel. The resulting free-standing, non-gapped cores were heat-treated in a convection oven with nitrogen atmosphere at temperatures of about 435–445° C. for 4–8 h. The cores were then allowed to cool to room temperature. The cores were inserted into a plastic winding form for testing. Each core's inductance was measured using a Hewlett Packard 4284A inductance bridge operating at 1 kHz with a winding of 6 turns. A core having a relative permeability of about 270 (as calculated from the inductance using the known formula for a toroidal inductor) was selected for further testing. Then secondary and primary turns were added to this core for high voltage testing. The secondary consisted of about 300 close-spaced turns of fine gauge wire occupying about 300° of the toroidal circumference. A primary of 6 turns of heavier gage wire was close-wound approximately in the center of remaining 60° gap. The resulting core-coil assembly was immersed in Fluorinert FC-70 dielectric fluid for testing. The primary was excited with a driver electronics comprising a 20 volt dc source charging a large capacitor and an IGBT switching element. The IGBT was triggered by an external pulse generator at about 10 Hz. All the waveforms were observed on a conventional oscilloscope with appropriate probes for the voltages concerned. A peak magnetomotive force as large as 500 amp-turns was achieved with a rise time of less than about 100 $\mu$s. FIGS. 8–11 depict the results of the testing of this core-coil assembly taken from the oscilloscope traces. The performance of the core-coil assembly was determined in both an open-circuit configuration and with the secondary discharging through a spark gap in air. The energy discharged through the spark gap was measured using an integrating thermoelectric, calorimetric wattmeter. FIG. 8 shows the open circuit secondary voltage resulting from the indicated level of primary drive in amp-turns. FIGS. 9–11, respectively, show the corresponding charge and discharge times and energy delivered with the secondary pulse fed into a spark gap. It may be noted that over 30 kV open circuit and 20 mJ per pulse into a spark gap are obtained at a drive of less than 500 amp-turns, rendering the core suitable for use in a high pulse rate, high energy ignition system.

Example 3

Figure 12:
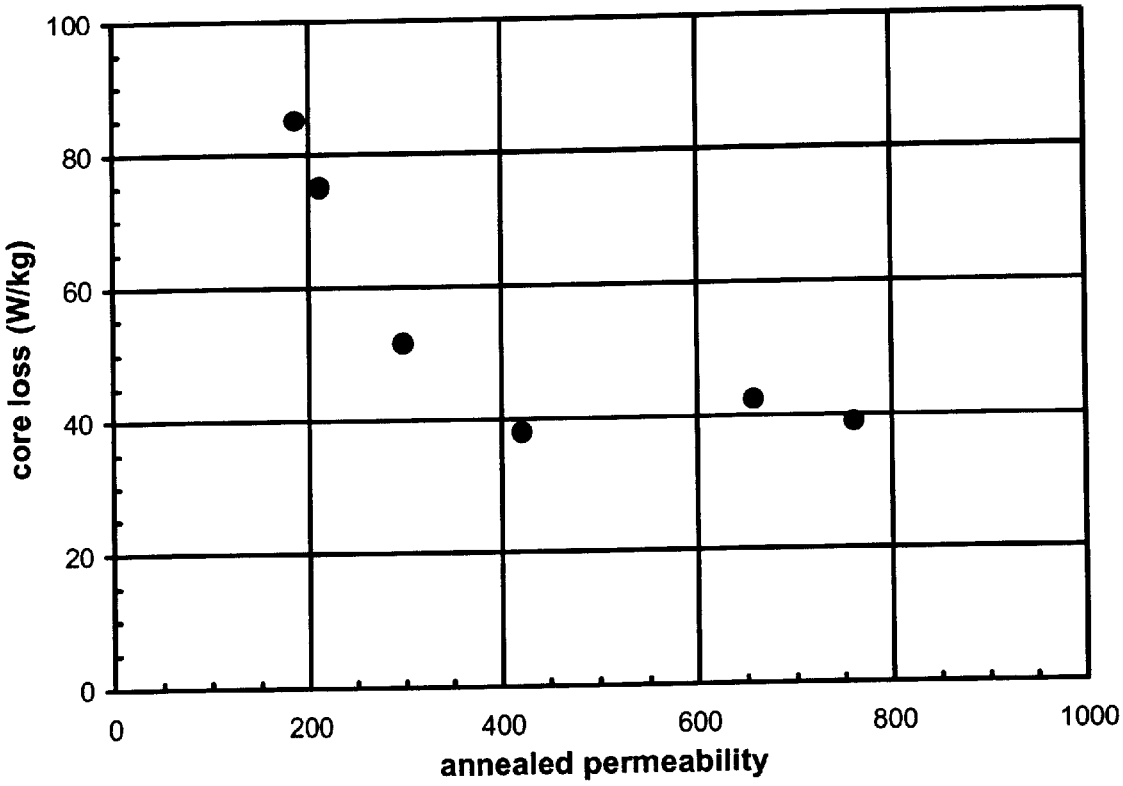
FIG. 12 depicts the relationship between core loss (measured with 100 kHz sinusoidal flux excitation to an induction of 0.1 T) and permeability of tape-wound toroids of ferromagnetic amorphous $Fe_{80}B_{11}Si_9$ alloy suitable for use in the magnetic core of the present invention.

Non-gapped, tape-wound toroidal cores were prepared using an iron-base, ferromagnetic amorphous alloy consisting essentially of a composition $Fe_{80}B_{11}Si_9$. Approximately 17 grams of ribbon having a width of 9.5 mm were wound onto a mandrel with a 12.5 mm diameter. The ribbon of each core was spot-welded at both the inner and outer diameters and the core removed from its mandrel. The resulting free-standing cores were heat-treated in a nitrogen atmosphere at a temperature of 435° C. for a series of times. The cores were allowed to cool to room temperature. For each core a winding of five turns was applied and the inductance measured using a Hewlett Packard 4284A inductance bridge. The permeability of the material in each core was calculated from the core's dimensions and its measured inductance. A winding of 15 turns was then applied. The core was connected to a source of 100 kHz AC current and excited to a peak sinusoidal flux density of 0.1 T. The core loss was determined from the voltage and current waveforms in the winding using a Clarke-Hess 288 electronic wattmeter. FIG. 12 depicts the relationship between the measured values of core loss and permeability for each core. It may be seen that permeability and core loss are generally inversely related. A core loss below about 100 W/kg is achieved in cores having an ungapped permeability as low as about 180, while a core loss below about 65 W/kg is achieved for a core with ungapped permeability of about 250 or greater. As a result of this combination of low core loss and moderate permeability the cores display both sufficiently high energy storage and sufficiently low core loss to render them suitable for the magnetic core-coil assembly of the invention.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. An ignition system for igniting fuel in a gas turbine or diesel engine comprising:

a magnetic core coil assembly including a magnetic core comprising at least one tape wound toroid including a ferromagnetic amorphous metal alloy, a primary winding for low voltage excitation, and a secondary winding for high voltage output, the ferromagnetic amorphous metal alloy having a composition defined essentially by the formula: $M_{70-85}Y_{5-20}Z_{0-20}$, subscripts in atom percent, where "M" is at least one of Fe, Ni and Co, "Y" is at least one of B, C and P, and "Z" is at least one of Si, Al and Ge; with the provisos that (i) up to 10 atom percent of component "M" can be replaced with at least one of the metallic species Ti, V, Cr, Mn, Cu, Zr, Nb, Mo, Ta, Hf, Ag, Au, Pd, Pt, and W, (ii) up to 10 atom percent of components (Y+Z) can be replaced by at least one of the non-metallic species In, Sn, Sb and Pb; and (iii) up to about one (1) atom percent of the components (M+Y+Z) can be incidental impurities; and driver electronics for applying a voltage to an electrode of a spark plug, wherein the driver electronics are associated with the core-coil assembly and are capable of supplying a current to the primary winding, the current resulting in a magnetomotive force that produces a magnetic field in the core in which energy is stored, wherein the driver electronics includes means for interrupting the current flow through the primary winding of the core-coil assembly causing the magnetic field within the core to collapse and thereby induce across the secondary winding a voltage that is carried to the electrode of the spark plug causing production of a spark igniting the fuel, and wherein the core-coil assembly and driver electronics are capable of operating with a rapid charge and discharge cycle to produce a high spark pulse rate.

2. The ignition system of claim 1 wherein the driver electronics comprises a DC voltage source, a capacitor, a switching element capable of opening and closing, and a timing control circuit.

3. An ignition system as recited by claim 1 wherein the magnetic core comprises a single tape-wound toroid encircled by the primary winding and the secondary winding.

4. An ignition system as recited by claim 1 wherein the magnetic core comprises a plurality of the tape-wound toroids secured in substantially coaxial alignment, the primary winding encircling all of said toroids, and the secondary winding comprises a plurality of secondary sub-windings connected in series, one of said secondary sub-windings encircling each of the toroids.

5. An ignition system as recited in claim 4, wherein said magnetic core comprises segmented cores.

6. An ignition system as recited in claim 4, wherein the assembly includes an internal voltage distribution that is segmentally stepped from bottom to top, the number of segments being determined by the number of tape wound toroids in the core.

7. An ignition system as recited by claim 1, wherein the ferromagnetic amorphous metal alloy is an iron-base alloy.

8. An ignition system as recited by claim 7, wherein the ferromagnetic amorphous metal alloy has been heat-treated at a temperature near the alloy's crystallization temperature and partially crystallized.

9. An ignition system as recited by claim 7, wherein the ferromagnetic amorphous metal alloy contains at least 70 atom percent Fe, at least 5 atom percent B, and at least 5 atom percent Si, and wherein the total content of B and Si is at least 15 atom percent.

10. An ignition system as recited by claim 9, wherein the ferromagnetic amorphous metal has a composition defined essentially by the formula $Fe_{80}B_{11}Si_9$.

11. An ignition system as recited by claim 7, wherein the ferromagnetic amorphous metal alloy has been heat-treated below the alloy's crystallization temperature and, upon completion of the heat treatment, remains substantially in an amorphous state.

12. An ignition system as recited by claim 1, wherein the ferromagnetic amorphous metal alloy is heat treated.

13. An ignition system as recited by claim 1 wherein each of the tape-wound toroids is gapped.

14. An ignition system as recited by claim 1 wherein each of the tape-wound toroids is non-gapped.

15. An ignition system as recited by claim 1 wherein the ferromagnetic amorphous metal alloy has a permeability ranging from about 250 to 500.

16. An ignition system as recited in claim 1 wherein the core-coil assembly generates a voltage rise ranging from about 200 to 500 nanoseconds, has an output impedance ranging from about 30 to 100 ohms, produces an open circuit voltage greater than about 25 kV, delivers peak current greater than about 0.5 amperes through the spark, provides a charge time of less than about 150 microseconds, provides a discharge time less than about 200 microseconds, and provides spark energy greater than about 5 millijoules per pulse when operated with the driver electronics.

17. An ignition system as recited in claim 1 wherein the driver electronics is powered by a voltage source of at least about 5 volts, and is capable of delivering pulse rates of at least about 500 Hz.

18. An ignition system as recited in claim 1 wherein the voltage across the secondary winding reaches more than 10 kV with a magnetomotive force of less than 70 ampere-turns and more than 20 kV with a magnetomotive force of 75 to 200 ampere-turns within about 20 to 150 microseconds.

19. An ignition system as recited in claim 1, wherein the core-coil assembly is adhesively secured inside a housing by a potting compound.

20. An ignition system as recited in claim 19, wherein the potting compound comprises a two part elastomeric polyurethane system having strong adhesion to said core-coil assembly, high dielectric strength, hardness in the mid Shore A range and a low dielectric constant.

21. An ignition system as recited in claim 19, wherein the potting compound comprises an anhydrous, two-component epoxy having strong adhesion to the core-coil assembly, high temperature electrical performance and good thermal shock resistance.

22. An ignition system as recited in claim 19, wherein the housing comprises a flexible high use temperature plastic with a high dielectric strength, low dielectric constant, good electrical properties, and good chemical resistance.

23. An ignition system as recited in claim 19, wherein the housing comprises an injection moldable glass-filled thermoplastic polyester with a $T_g$ near the maximum operating temperature of the assembly and a coefficient of thermal expansion matched to that of the potting compound.

24. An ignition system as recited in claim 19, wherein the housing comprises a member of the group consisting of polyphenylene ether/polypropylene blends, polymethylpentene/polyolefin blends and polycylcolefin/polyolefin blends.

25. An ignition system as recited in claim 19, wherein the housing comprises a polyphenylene ether/polypropylene blend that is flexible, has a low dielectric constant, good electrical properties, good chemical resistance and is injection moldable and the potting compound comprises a two part elastomeric polyurethane.

26. A method for producing a core-coil assembly comprising:

producing a magnetic assembly that includes a magnetic core comprising at least one tape wound toroid including a ferromagnetic amorphous metal alloy, a primary winding for low voltage excitation, and a secondary winding for high voltage output, the ferromagnetic amorphous metal alloy having a composition defined essentially by the formula: $M_{70-85}Y_{5-20}Z_{0-20}$, subscripts in atom percent, where "M" is at least one of Fe, Ni and Co, "Y" is at least one of B, C and P, and "Z" is at least one of Si, Al and Ge; with the provisos that (i) up to 10 atom percent of component "M" can be replaced with at least one of the metallic species Ti, V, Cr, Mn, Cu, Zr, Nb, Mo, Ta, Hf, Ag, Au, Pd, Pt, and W, (ii) up to 10 atom percent of components (Y+Z) can be replaced by at least one of the non-metallic species In, Sn, Sb and Pb; and (iii) up to about one (1) atom percent of the components (M+Y+Z) can be incidental impurities; and adhesively securing the core-coil assembly with a potting compound to a housing.

27. The method of claim 26 further comprising connecting driver electronics to the core coil assembly for applying a voltage to an electrode of a spark plug, wherein the driver electronics supplies a current to the primary winding, the current resulting in a magnetomotive force that produces a magnetic field in the core in which energy is stored, wherein the driver electronics includes means for interrupting the current flow through the primary winding of the core-coil assembly causing the magnetic field within the core to collapse and thereby induce across the secondary winding a voltage that is carried to the electrode of the spark plug causing production of a spark igniting the fuel, and wherein the core-coil assembly and driver electronics are capable of operating with a rapid charge and discharge cycle to produce a high spark pulse rate.

28. The method of claim 26 further comprising preparing and plasma cleaning the surfaces of each of the components of the core-coil assembly and the housing prior to adhesively securing the core-coil assembly to the housing with potting compound.

* * * * *